US006796677B1

(12) United States Patent
Mohacsi

(10) Patent No.: US 6,796,677 B1
(45) Date of Patent: Sep. 28, 2004

(54) HIGH INTENSITY LAMP

(75) Inventor: Ferenc Mohacsi, Muskego, WI (US)

(73) Assignee: Everbrite, Inc., Greenfield, WI (US)

( * ) Notice: Subject to any disclaimer, the term of this patent is extended or adjusted under 35 U.S.C. 154(b) by 25 days.

(21) Appl. No.: 10/031,717

(22) PCT Filed: Jun. 22, 2000

(86) PCT No.: PCT/US00/17149

§ 371 (c)(1),
(2), (4) Date: Apr. 16, 2002

(87) PCT Pub. No.: WO01/07827

PCT Pub. Date: Feb. 1, 2001

Related U.S. Application Data

(60) Provisional application No. 60/145,326, filed on Jul. 23, 1999.

(51) Int. Cl.[7] ..... F21S 4/00

(52) U.S. Cl. ..... 362/223; 362/217; 362/263; 362/328

(58) Field of Search ..... 313/113; 362/255, 362/263, 256, 339, 340, 223, 217, 296, 311, 334, 335, 336, 337, 326, 328, 329

(56) References Cited

U.S. PATENT DOCUMENTS

| | | | | | |
|---|---|---|---|---|---|
| 3,875,561 | A | | 4/1975 | Scarpino et al. | |
| 4,208,604 | A | | 6/1980 | Couwenberg | |
| 4,434,385 | A | | 2/1984 | Touho et al. | |
| 4,924,141 | A | | 5/1990 | Taubner et al. | |
| 4,945,461 | A | | 7/1990 | Crates | |
| 4,991,070 | A | * | 2/1991 | Stob | 362/223 |
| 4,992,695 | A | | 2/1991 | Naum | |
| 5,034,864 | A | * | 7/1991 | Oe | 362/224 |
| 5,095,415 | A | * | 3/1992 | Anderson et al. | 362/329 |
| 5,101,331 | A | | 3/1992 | Katoh et al. | |
| 5,233,262 | A | | 8/1993 | Lynn et al. | |
| 5,237,766 | A | * | 8/1993 | Mikolay | 40/564 |
| 5,315,491 | A | | 5/1994 | Spencer et al. | |
| 5,384,658 | A | * | 1/1995 | Ohtake et al. | 359/707 |
| 5,414,600 | A | | 5/1995 | Strobl et al. | |
| 5,430,634 | A | | 7/1995 | Baker et al. | |
| 5,530,633 | A | * | 6/1996 | Yuen | 362/184 |
| 5,735,595 | A | * | 4/1998 | Nederpel et al. | 362/223 |
| 5,743,628 | A | | 4/1998 | Greif et al. | |
| 5,883,684 | A | * | 3/1999 | Millikan et al. | 349/65 |
| 6,099,148 | A | * | 8/2000 | Northrup et al. | 362/336 |
| 6,435,696 | B1 | * | 8/2002 | Foottit | 362/219 |
| 6,494,605 | B1 | * | 12/2002 | Doell | 362/581 |
| 6,523,984 | B2 | * | 2/2003 | Belfer | 362/551 |

FOREIGN PATENT DOCUMENTS

| | | |
|---|---|---|
| EP | 2166860 | 5/1986 |
| EP | 0765071 | 3/1997 |

* cited by examiner

*Primary Examiner*—Thomas M. Sember
*Assistant Examiner*—John Anthony Ward
(74) *Attorney, Agent, or Firm*—Michael Best & Friedrich, LLP

(57) ABSTRACT

A high intensity lighting device (2) is provided. The lighting device has a linear light source (4), a reflective member (6), and a translucent region (14). The linear light source and reflective member typically share a common axis. The reflective member, which can take many shapes, causes light which would normally be absorbed or propagated within a light housing (8) to converge on the translucent region. The translucent region having a longitudinal axis coincident to the common axis focuses rays of light to an intended area. If desired, a lens (44) may also be used to collimate the light such as a cylindrical lens or one or more prisms (50) for example.

51 Claims, 5 Drawing Sheets

HIGH INTENSITY LAMP

This application claims the benefit of Provisional application Ser. No. 60/145,326, filed Jul. 23, 1999.

BACKGROUND OF THE INVENTION

The present invention relates to lighting devices, and more particularly, to illumination devices adapted to provide high intensity lighting.

A known problem with using typical prior art lights in high intensity applications is that the lights consume large quantities of power and generate excessive heat in comparison to other lighting devices. These applications thereby suffer not only from higher operating costs and limited portability due to the devices large power consumption, but also can become susceptible to premature failure due to the prolonged exposure to excessive heat.

SUMMARY OF THE INVENTION

The invention mitigates the above-described problems by providing high intensity lighting devices that employ a reflective member and a linear light source, which by way of example can be a gas discharge lamp, such as a fluorescent lamp, a mercury vapor lamp, or a neon lamp, or a linear incandescent lamp. The linear light source and reflective member typically share a common axis that extends through their lengths.

More specifically, the present invention provides a lighting device having a high luminous intensity. The lighting device comprises a linear light source, a reflective member, and a translucent region. Preferably, the reflective member is shaped and sized to securely engage the linear light source and the translucent region. which is typically transparent. In this design, the lighting device may be sealed from moisture and contaminants and may be shielded from shock.

In one aspect of the invention, the reflective member comprises a reflector having at least three polygonal-shaped sides. The reflector is preferably located near the ends of the linear light source to direct rays of light toward an intermediate translucent region. In alternative embodiments, the reflective member may include more than one reflector, and each reflector may have a generally conical shape. The generally conical shape may comprise circular, triangular, elliptical, parabolic, and other cross-sectional shapes to control the transmission pattern of light. Preferably, when the reflector has circular cross-sections, its smallest circular cross-section is positioned adjacent to an end of the linear light source.

The above-described reflective member may comprise a specular or a diffuse reflector. Preferably, the reflective member further comprises a coating or reflective film, such as a silver reflective film. A coating or reflective film offers the advantage of reflecting light with minimal absorption which further increases the luminosity of the lighting device.

In another aspect of the invention, the translucent region has a substantially cylindrical shape with a central axis typically coincident with the common axis of the linear light source and the reflective member. Alternatively, the translucent region can have a number of circumferential lengths or arcs. Lenses may also be used in this aspect of the invention so that rays of light incident on the translucent region are refracted into an array of substantially parallel light rays emitted from the lighting device.

In yet another aspect of the invention, the translucent region may comprise a plurality of prisms. In one exemplary embodiment, prismatic light reflective material comprised of a plurality of substantially prism like members refract light at different angles to emit an array of substantially parallel light rays from the lighting device. These transmissive prisms refract light traveling in many different directions to produce a highly luminous collimated array of light.

The reflective member has a substantially total internal reflectance (TIR) so that substantially all of the light produced by the light source is emitted from the lighting device through the translucent region, and is preferably collimated by a lens unitarily formed or interconnected with the translucent region. The axial length of the translucent region may comprise only a small portion of the total axial length of the light source, such as on the order of one to seventy five percent, with ten to fifty percent being preferred. Nevertheless, substantially all of the light produced by the light source is emitted only through the translucent region, resulting in a high intensity lighting device.

The disclosed devices consume little power and do not produce excessive heat in comparison to known lighting devices. The reflective members can be shaped and sized to a variety of linear light sources so that a variety of lights can be created from few parts, rendering a highly adaptable technology that is economical to operate and inexpensive to construct. These features as well as other advantages of the invention will become apparent upon consideration of the following detailed description and accompanying drawings of the embodiments of the invention described below.

DETAILED DESCRIPTION

Figure 1:
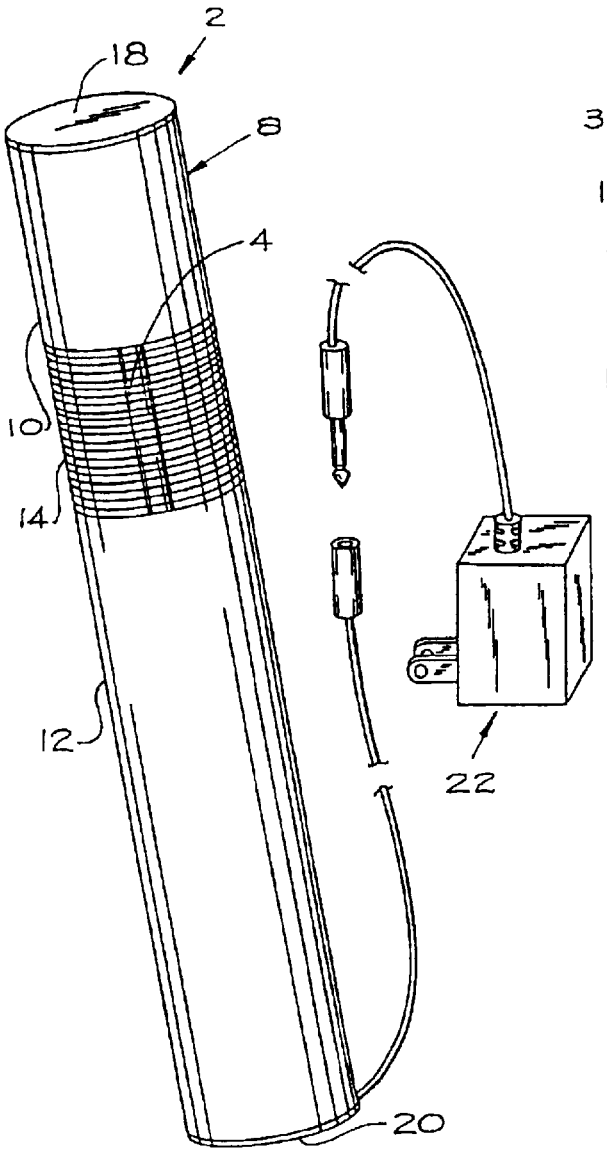
FIG. 1 is a perspective view of a preferred embodiment of the invention.

In the drawings, depicted elements are not necessarily drawn to scale, and alike and similar elements are designated by the same reference numeral through several views.

Figure 2:
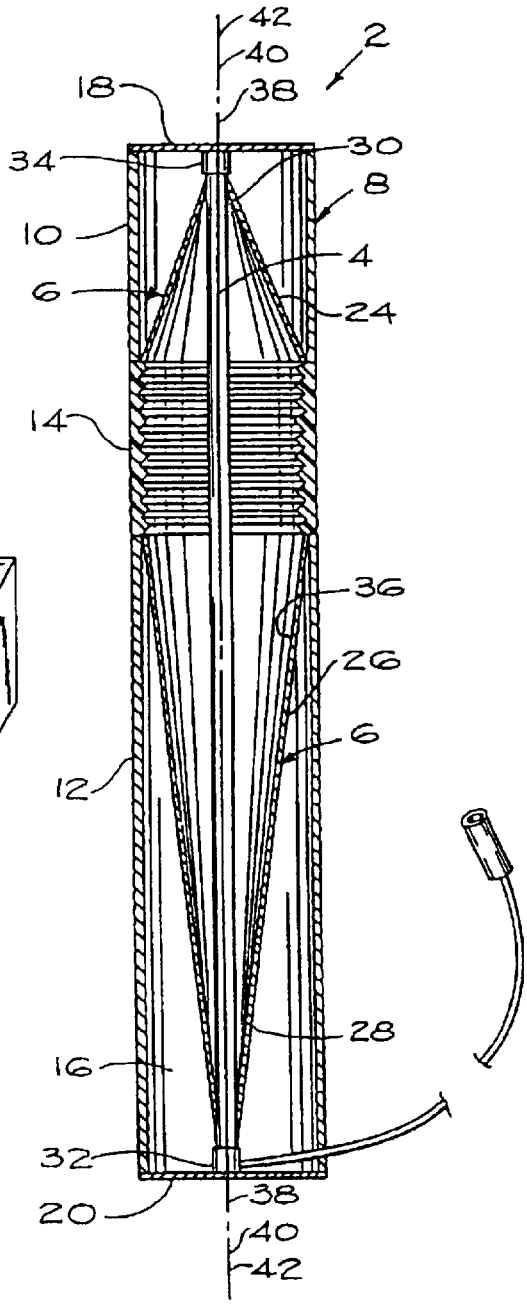
FIG. 2 is a side view of the preferred embodiment of FIG. 1 with a sidewall partially removed.

FIGS. 1 and 2, illustrate the invention. The illustrated lighting device 2 has a linear light source 4 and a reflective member 6 partially disposed within a substantially cylindrical housing 8. The housing 8 has a first portion 10 and a second portion 12 separated by a translucent region 14. The first portion 10 and second portion 12, in turn, form a sealed cavity 16 with the translucent region 14 for receiving the linear light source 4, the reflective member 6, a ballast type power supply if a gas discharge lamp is used, and any other control circuitry.

The illustrated linear light source 4 is preferably a linear gas discharge lamp that operates cooler and more efficiently than incandescent lamps that emit light by heating a high resistant filament. However, a linear incandescent lamp may also be used. The inside of the gas discharge lamp is coated with phosphors, a substance that absorbs ultraviolet radiation and reradiate the ultraviolet radiation as visible light. Colored phosphors are used to change the wavelength of the output light. A ballast is also used with gas discharge lamps to provide the voltage needed to ionize the gas and thereby emit light.

A power supply 22, shown in FIG. 1, provides direct current to the linear light source 4. A rectifier converts alternating current into direct current, which is capacitively filtered. In one exemplary embodiment, full-wave rectification converts one hundred and twenty volts alternating current into twelve volts direct current to drive a small fluorescent lamp ballast. Obviously, other stationary or portable power supplies, power supply configurations, and operating voltages can also be used. The power source should be designed to the requirements of the light source.

The reflective member 6, which is illustrated as a pair of hollow conical reflectors 24 and 26, is located within the first and second portions 10 and 12 of the housing 8, respectively. In a preferred embodiment, the smallest circular cross-sections 28 and 30 of the two conical reflectors 24 and 26 are positioned near the respective proximal and distal ends 32 and 34 of the linear light source 4. The diameters of these circular cross-sections 28 and 30 are sized to securely engage the linear light source 4.

The reflective member 6 may have three or more polygonal shaped sides that are shaped as triangles or as other closed geometric shapes. Alternatively, the reflective member 6 may have one or more conical sides.

Reflective member 6 can be made of metal, plastic, glass, or other rigid materials. Since these materials serve only to provide a desired form for the reflective member 6 and provide physical support for a reflective film or coating, the materials do not have to meet a high optical quality standard.

A silver reflective film coupled to the interior surface 36 of the reflector 6 is used to reflect light toward the translucent region. The reflective film manufactured by 3M Corporation of St. Paul Minn. under the trademark "SILVER-LUX" is used as the principal reflective material, although other reflective films and coatings may also be used. These films and coatings may be deposited, sprayed, or affixed by other known means to the interior surface 36 of the reflective member 6. Alternatively, the reflective member 6 may comprise a polished surface or a naturally reflective surface such as a drawn aluminum alloy.

It can be seen in FIG. 2, that the longitudinal axis 38 of the linear light source 4 and the axis 40 of the reflective member 6 are substantially coincident. This geometry causes light that would normally be absorbed or propagated within the housing 8 to converge on the translucent region 14.

As shown in FIG. 2, the translucent region 14 has a substantially cylindrical shape with a central axis 42 substantially coincident with the longitudinal axis 38 of the linear light source 4. The translucent region 14 may be made of glass, or a plastic material (i.e. acrylic, polycarbonate, silicone, etc.), or any other light transmissive material and may include a lens 44 (shown in FIG. 3) that focuses rays of light toward an intended area. Alternatively, the translucent region 14 may have any of a number of axial lengths or arcs, and may, for example, comprise only a small axial length or arc of the housing 8. Preferably, the translucent region 14 is substantially cylindrical in shape and has a constant radius of curvature.

Figure 3:
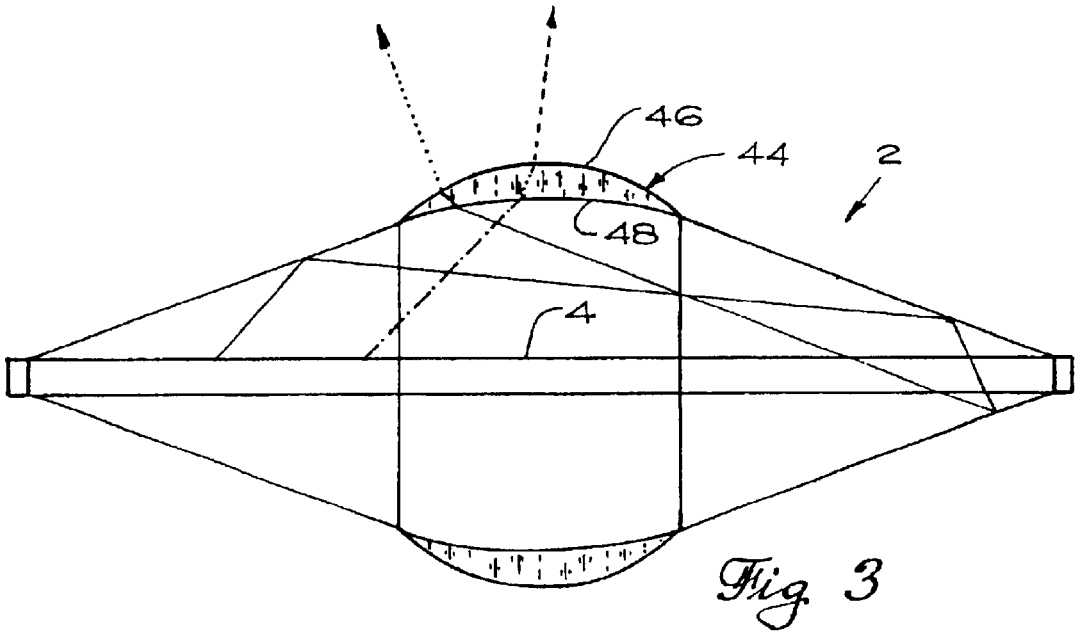
FIG. 3 is a cross-sectional view of an alternate embodiment with a lens.
Figure 4:
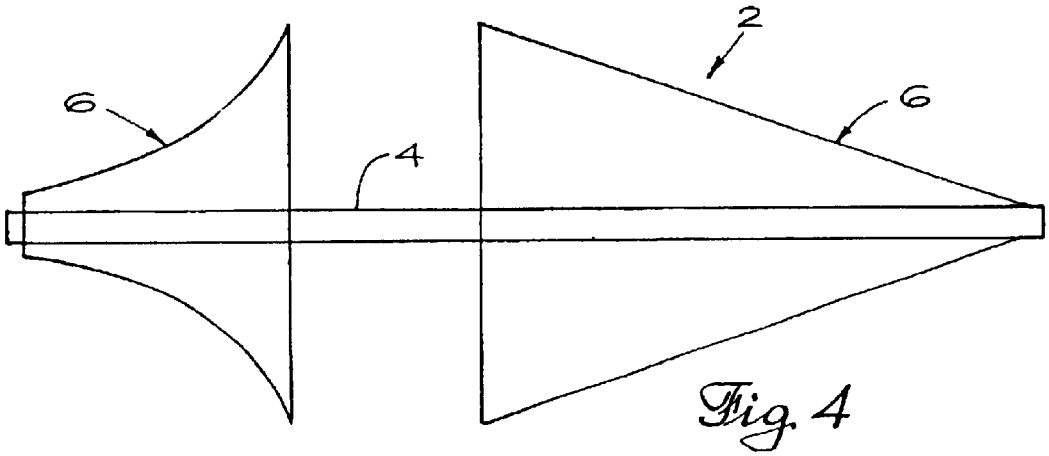
FIG. 4 is a cross-sectional view of a further embodiment of the invention.

A single lens 44 as shown in FIG. 3, or a compound lens (not shown) may also be used to improve the efficiency of the invention. As shown, the single lens 44 has two ground or polished surfaces, with the outer surface 46 being convex and the inner surface 48 being concave.

Figure 7:
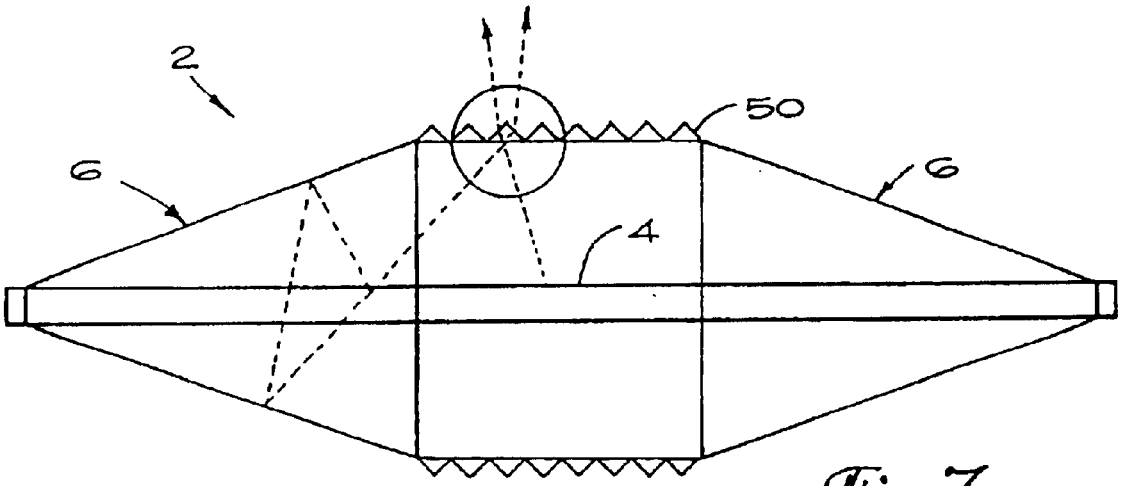
FIG. 7 is a cross-sectional view of a further embodiment of the invention.
Figure 8:
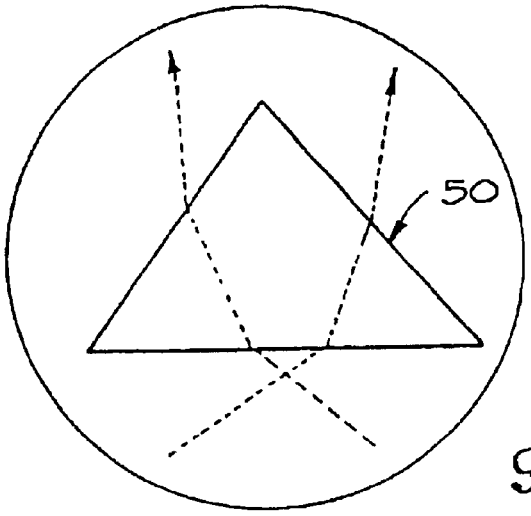
FIG. 8 is an exploded view of the prisms of the embodiment of FIG. 7.

If desired, a number of other types of lenses may also be used. Lenses made of prism-like members 50 also known as microprisms as shown in FIGS. 7 and 8, for example, may be used to refract the light that falls incident on the translucent region 14. The prismatic light refractive material or film comprises a plurality of substantially prism like members 50 that refract light into a parallel array. These transmissive prisms 50 refract light traveling in many different directions to produce a highly luminous collimated array of light. Sheet like layers of microprisms manufactured by 3M Corporation of St. Paul Minn. under the trademark "BEF" (Brightness Enhancing Film) may be used as the principal prism lens.

Figure 5:
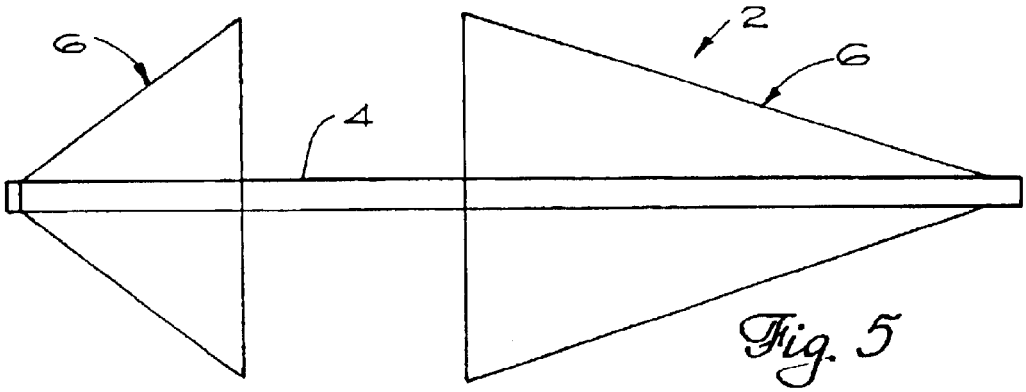
FIG. 5 is a cross-sectional view of a further embodiment of the invention.
Figure 6:
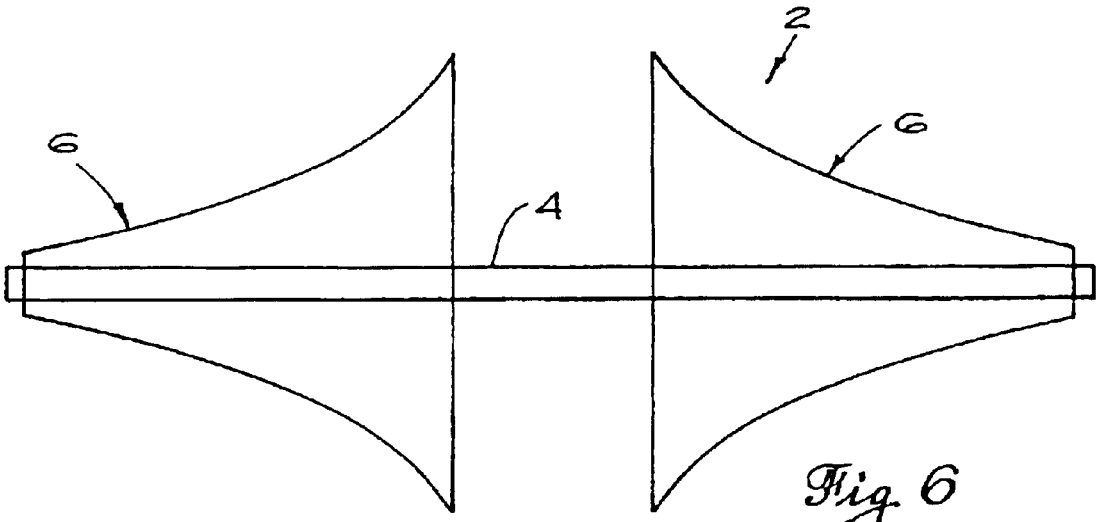
FIG. 6 is a cross-sectional view of a further embodiment of the invention.
Figure 10:
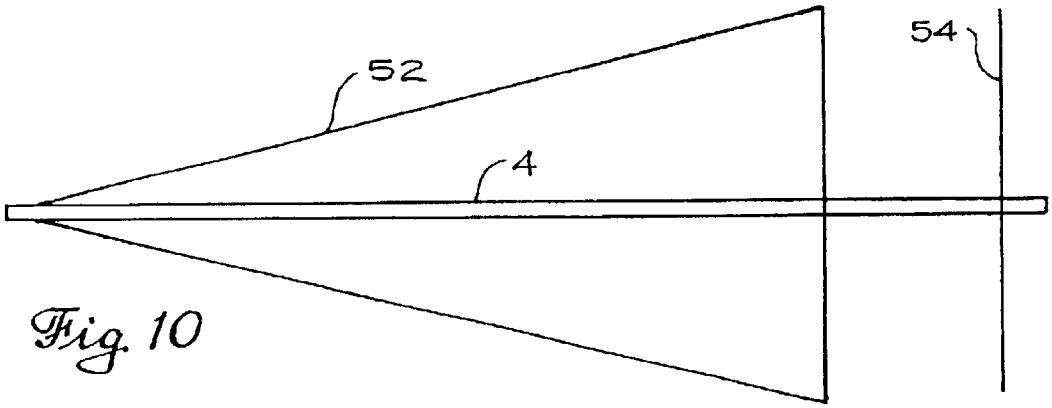
FIG. 10 is a cross-sectional view of a further embodiment of the invention.
Figure 11:
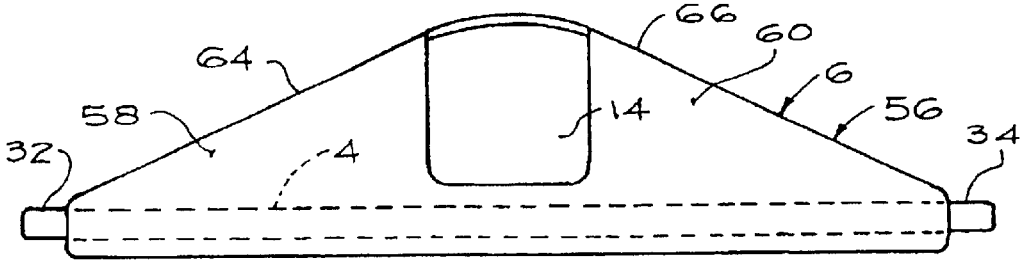
FIG. 11 is a side view of a further embodiment of the invention.
Figure 13:
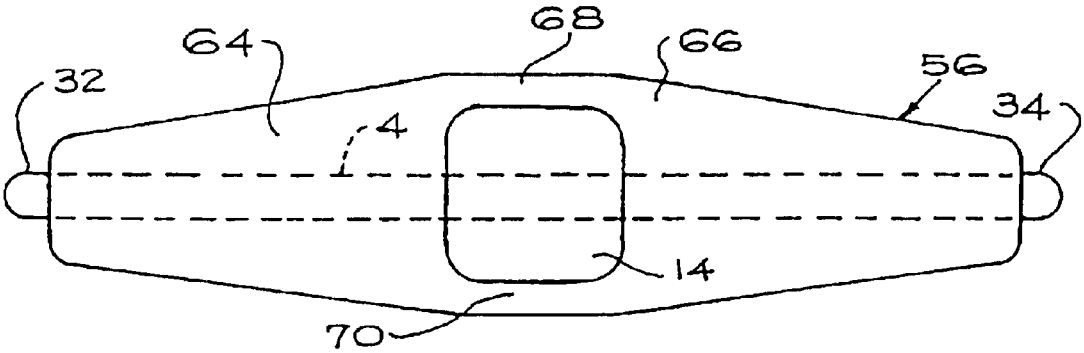
FIG. 13 is a top view of the embodiment of FIG. 11.

It should be noted that the invention is not limited to the illustrated dimensions, combinations of geometric shapes, or to the geometric shapes of the reflective members 6 shown in the accompanying figures. Thus, the substantially-conical shapes of the reflective members 6 shown in FIGS. 5 and 8, the profiles of the reflective member 6 shown in FIG. 6, the combination of geometric shapes that comprise the reflective member 6, such as a substantially hollow conical and a plane reflectors 52 and 54 of FIG. 10, and the varying lengths of the reflective members 6 shown in the other figures, illustrate only a few of the many forms that the invention can take. As shown in FIGS. 11 and 13, the reflective member 6 may also comprise any substantially enclosed reflective housing 56.

Figure 12:
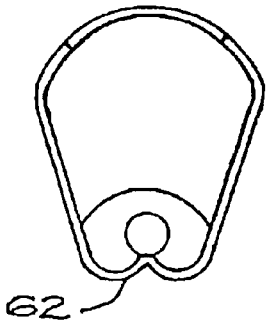
FIG. 12 is an end view of the embodiment of FIG. 11.

The curvlineal reflective housing 56 illustrated in FIGS. 11–13 comprise two portions 58 and 60. A concave recess 62 extending along the length of the reflective housing 56 forms one portion of the housing while oppositely sloped walls 64 and 66 contiguous with a pair of curved portions 68 and 70 partially form an opposite portion of the housing 56. The reflective housing 56 substantially encloses the linear light source 4, such that the translucent region 14 positioned intermediate of the proximal and distal ends 32 and 34 of the linear light source 4 emits substantially all of the light produced by the linear light source 4. As in many of the previously described embodiments, the longitudinal axis of the housing 56 is substantially coincident with the axis of the linear light source 4.

Each reflective member 6 or portion shown in each of the figures can vary from the illustrations. These reflective members 6 and variations thereof, illustrate the structure for performing the function of directing light from the linear light source 4 toward the translucent region 14.

Figure 9:
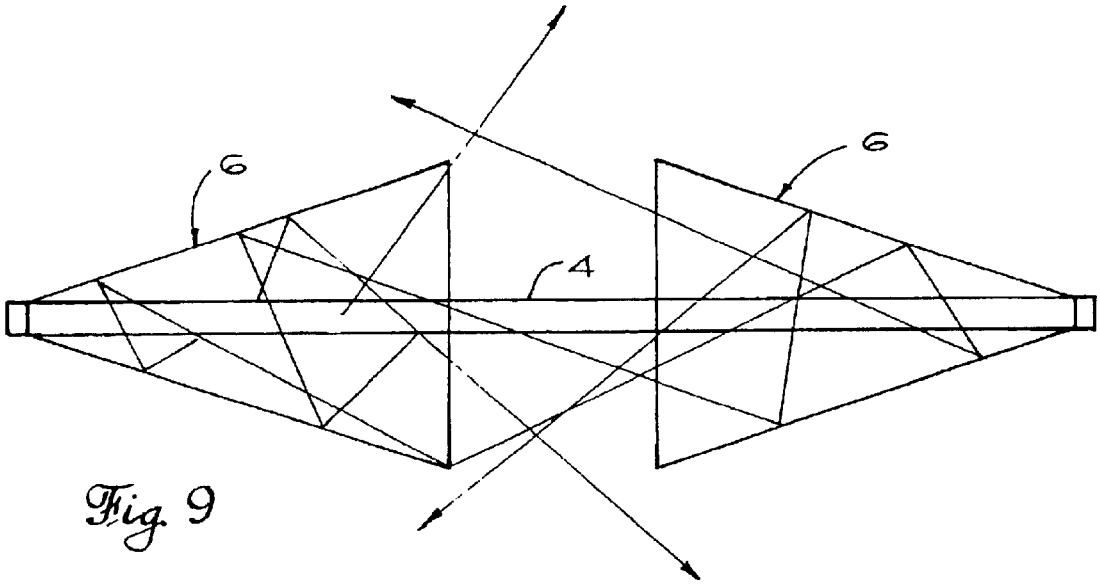
FIG. 9 is a cross-sectional view of a further embodiment of the invention partially illustrating the light paths of the reflected light.

While it is not intended that the reflective member 6 be limited to any particular type of reflector, the preferred embodiments of the invention employed specular and diffuse reflectors. As shown in FIG. 9, the reflective member 6 provides a number of advantages including reflecting substantially all of the light emitted from the linear light source 4 to the translucent region 14.

In the normal application of the invention, the translucent region 14 can be positioned anywhere from the proximal to the distal ends 32 and 34 of the linear light source 4 wherein the axial length of the translucent region can be substantially between one to fifty percent of the axial length of the linear light source 4. The circumferential length or arc of the translucent region 14 can also vary anywhere from allowing up to three hundred and sixty degrees of output to an arc that allows less than three hundred and sixty degrees of output.

Given that the luminous intensity of the invention is achieved by internally reflecting much of the linear light source's output from within a housing through only a relatively small translucent region, the invention encompasses any structure that can achieve that function. For example, the linear light source 4 and reflective member 6 axis 38 and 40 do not have to be coincident nor do any of the disclosed axis 38, 40, and 42 have to be coincident.

The descriptions set forth in Table 1 below are provided to illustrate a few of the many forms that the invention may take along with their respective properties. These examples should not be considered limiting.

TABLE 1

| | | |
|---|---|---|
| Example 1 | 16,500 | Candela* |
| Luminous intensity of linear light source (fluorescent tube) | | |
| Luminous intensity of the device output | 40,950 | Candela |
| Illuminated length of linear light source | 170 | Millimeters |
| Translucent region longitudinal length | 35 | Millimeters |
| Current rating | 10 | Milliamperes |
| Housing diameter | 80 | Millimeters |
| Example 2 | | |
| Luminous intensity of linear light source (fluorescent tube) | 13,470 | Candela |
| Luminous intensity of the device output | 28,910 | Candela |
| Illuminated length of linear light source | 100 | Millimeters |
| Translucent region longitudinal length | 30 | Millimeters |
| Current rating | 5 | Milliamperes |
| Housing diameter | 25 | Millimeters |

*A unit of luminous intensity equal to 1/60 of the luminous intensity per square centimeter of a blackbody radiating at the temperature of solidification of platinum (2,046° K.).

The foregoing detailed description describes only a few of the many forms that the present invention can take, and should therefore be taken as illustrative rather than limiting. It is only the following claims, including all equivalents that are intended to define the scope of the invention.

What is claimed is:

1. A lighting device, comprising:

a linear light source having a longitudinal axis, and having a first end and a second end defining a light-emitting length therebetween;

a translucent region positioned substantially intermediate said first and said second ends, said translucent region having a length substantially less than the light-emitting length; and a reflective member having an axis substantially coincident with said longitudinal axis, said reflective member positioned intermediate said first end and said translucent region to direct light emitted from a substantial portion of said linear light source toward said translucent region.

2. The lighting device of claim 1, wherein said linear light source comprises a gas discharge lamp.

3. The lighting device of claim 1, wherein said translucent region comprises a lens.

4. The lighting device of claim 3, wherein said lens comprises at least one of a convex and a concave surface.

5. The lighting device of claim 1, wherein said translucent region comprises a plurality of prisms.

6. The lighting device of claim 1, wherein said reflective member is shaped and sized to securely engage said linear light source and said translucent region.

7. The lighting device of claim 1, wherein said reflective member comprises a reflector having at least three polygonal sides.

8. The lighting device of claim 1, wherein said reflective member comprises more than one reflector having at least three polygonal sides.

9. The lighting device of claim 1, wherein said reflective member comprises at least one substantially conical shaped reflector.

10. The lighting device of claim 9, wherein said at least one substantially conical shaped reflector includes two conical-shaped reflectors of different corresponding diameters and the smaller of said conical shaped reflectors is oriented toward an end of said linear light source.

11. The lighting device of claim 1, wherein said reflective member comprises more than one substantially conical shaped reflector having circular cross-sections in which the smallest of each of said circular cross-sections of each of said reflectors is oriented toward an end of said linear light source.

12. The lighting device of claim 9, wherein said substantially conical shaped reflector has a substantially right circular cone shape.

13. The lighting device of claim 10, wherein each of said substantially conical shaped reflectors has a different axial length.

14. The lighting device of claim 1, wherein said translucent region has a substantially cylindrical shape and a central axis coincident with said longitudinal axis.

15. The lighting device of claim 1, wherein said translucent region emits a substantially collimated beam of light.

16. The lighting device of claim 1, wherein said reflective member comprises a specular reflector.

17. The lighting device of claim 1, wherein said reflective member comprises a diffuse reflector.

18. The lighting device of claim 1, wherein said reflective member comprises a reflective coating affixed to a surface.

19. The lighting device of claim 1, wherein said reflective member includes a silver reflective film.

20. The lighting device of claim 1, wherein said reflective member comprises a metal reflector.

21. The lighting device of claim 1, wherein said reflective member comprises a reflective film.

22. The lighting device of claim 1, wherein said translucent region has an arc of 360 degrees.

23. The lighting device of claim 1, wherein said translucent region has an arc of less than 360 degrees.

24. The lighting device of claim 1, wherein the length of the translucent region is approximately fifty percent of the light-emitting length.

25. The lighting device of claim 1, wherein the length of the translucent region is between about one percent and about fifty percent of the light-emitting length.

26. The lighting device of claim 1, further comprising a second reflective member positioned intermediate said second end and said translucent region to direct light emitted from said linear light source toward said translucent region.

27. The lighting device of claim 26, wherein the translucent region, the reflective member, and the second reflective member together extend substantially the full light-emitting length.

28. A lighting device, comprising:

a linear light source having a first end and a second end;

a translucent region positioned substantially intermediate said first and said second ends, said translucent region completely surrounding a portion of the linear light source; and means for directing light emitted from said linear light source toward said translucent region, said directing means having a common longitudinal axis with said linear light source, wherein said directing means comprises at least one substantially conical shaped reflector.

29. The lighting device of claim 28, wherein said linear light source comprises a gas discharge lamp.

30. The lighting device of claim 28, wherein said translucent region comprises a lens.

31. The lighting device of claim 30, wherein said lens comprises at least one of a convex and a concave surface.

32. The lighting device of claim 28, wherein said translucent region comprises a plurality of prisms.

33. The lighting device of claim 28, wherein said directing means is shaped and sized to securely engage said linear light source and said translucent region.

34. The lighting device of claim 28, wherein said directing means comprises more than one reflector having at least three polygonal sides.

35. The lighting device of claim 28, wherein said at least one substantially conical shaped reflector includes two conical-shaped reflectors of different corresponding diameters and the smaller of said conical shaped reflectors is orientated toward an end of said linear light source.

36. The lighting device of claim 35, wherein each of said substantially conical shaped reflectors has a different axial length.

37. The lighting device of claim 28, wherein said directing means comprises more than one substantially conical shaped reflector having circular cross-sections in which the smallest of each of said circular cross-sections of each of said reflectors is orientated toward an end of said linear light source.

38. The lighting device of claim 28, wherein said substantially conical shaped reflector has a substantially right circular cone shape.

39. The lighting device of claim 28, wherein said translucent region has a substantially cylindrical shape and a central axis coincident with said longitudinal axis.

40. The lighting device of claim 28, wherein said translucent region emits a substantially collimated beam of light.

41. The lighting device of claim 28, wherein said directing means comprises a specular reflector.

42. The lighting device of claim 28, wherein said directing means comprises a diffuse reflector.

43. The lighting device of claim 28, wherein said directing means comprises a reflective coating affixed to a surface.

44. The lighting device of claim 28, wherein said directing means includes a silver reflective film.

45. The lighting device of claim 28, wherein said directing means comprises a metal reflector.

46. The lighting device of claim 28, wherein said directing means includes a reflective film.

47. The lighting device of claim 28, wherein said directing means comprises a reflective coating coupled to a surface.

48. The lighting device of claim 28, wherein said directing means comprises a metal reflector.

49. The lighting device of claim 28, wherein the linear light source defines a light-emitting length that extends from the first end to the second end, and the translucent region defines a length, and wherein the length of the translucent region is approximately fifty percent of the light-emitting length.

50. The lighting device of claim 28, wherein the linear light source defines a light-emitting length that extends from the first end to the second end, and the translucent region defines a length, and wherein the length of the translucent region is between about one percent and about fifty percent of the light-emitting length.

51. A lighting device comprising:

a linear light source having a first end and a second end;

a translucent region positioned substantially intermediate said first and said second ends, said translucent region completely surrounding a portion of the linear light source; and means for directing light emitted from said linear light source toward said translucent region, said directing means having a common longitudinal axis with said linear light source, wherein said directing means comprises a reflector having at least three polygonal sides.

* * * * *